United States Patent [19]

Kitzinger

[11] Patent Number: 4,897,577

[45] Date of Patent: Jan. 30, 1990

[54] ELECTROMECHANICALLY TRIGGERED SPARK GAP SWITCH

[75] Inventor: Frank Kitzinger, Montreal, Canada

[73] Assignee: Noranda Inc., Toronto, Canada

[21] Appl. No.: 196,566

[22] Filed: May 20, 1988

[30] Foreign Application Priority Data

Jul. 20, 1987 [CA] Canada ..... 542475

[51] Int. Cl.[4] ..... H01J 17/04

[52] U.S. Cl. ..... 315/55; 313/325; 313/602; 313/622

[58] Field of Search ..... 315/55, 146, 325, 595, 315/601, 602, 618, 621, 622, 631, 632, 633

[56] References Cited

U.S. PATENT DOCUMENTS 2,717,589 9/1955 Harkness ..... 315/55

3,757,153 9/1973 James ..... 313/622 X

FOREIGN PATENT DOCUMENTS 0211474 7/1984 German Democratic Rep. ... 315/55

*Primary Examiner*—David Mis

*Attorney, Agent, or Firm*—Fleit, Jacobson, Cohn, Price, Holman & Stern

[57] ABSTRACT

A spark gap switch is disclosed. The spark gap switch comprises an anode and a cathode having facing surfaces separated by a predetermined gap, a trigger electrode located in the vicinity of such gap, and a piezoelectric generator connected between the trigger electrode and the cathode for triggering the spark gap switch.

5 Claims, 1 Drawing Sheet

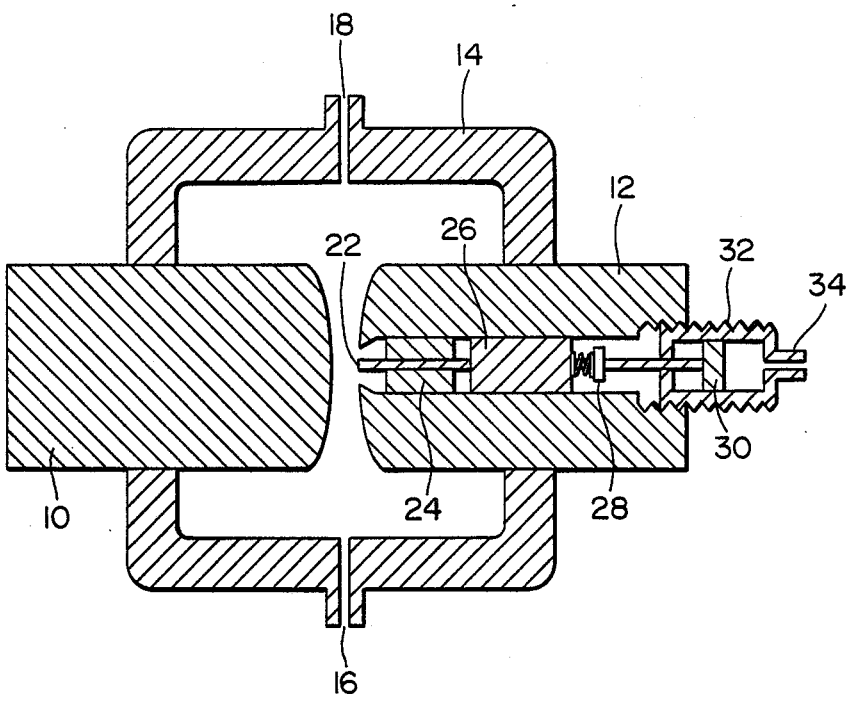
18
14
12
22
26
32
34
30
10
24
28
16

ELECTROMECHANICALLY TRIGGERED SPARK GAP SWITCH

This invention relates to an electromechanically triggered spark gap switch suitable for switching high voltage, high current electrical power.

Spark gaps were the earliest switching means for high voltage capacitor discharges. In its simplest form, a spark gap switch consists of two metal electrodes axially spaced apart. Air or other gases fill the gap between the electrodes. The switching potential of such an arrangement will depend on the shape and distance of the electrodes, the density and the pressure of the gas (Paschen's law). When the potential difference between the electrodes reaches the breakdown potential of the gas at the given distance and pressure, sparkover occurs. The spark resistance is very low, usually in the milliohm range, therefore the switching efficiency is high.

Over the years other high voltage, high current switching devices were developed, but the spark gap switch remained an important, often used component. There are several methods to turn on a spark gap switch:

1. The potential difference between the electrodes can be increased to initiate switching. This is usually inconvenient, because other factors determine the voltage to be used.

2. The gas pressure can be lowered until breakdown occurs. This method requires pressure control equipment.

3. The gas density can be lowered by changing the composition. This method necessitates the use of multiple gas sources.

4. The gap size can be decreased by moving the electrodes closer. This requires flexible leads, which may be inconvenient considering the heavy, high current conductors. Flexible leads also tend to increase the system inductance, which in turn slows the discharge process.

5. Local ionization of the gas within the gap is a convenient way of operating the switch. One method of ionization is to introduce a small spark between the cathode and a third electrode as described by U.S. Pat. 3,757,153, column 2, lines 56–66. Another description of such method can be found in HIGH SPEED PULSE TECHNOLOGY, by F.B.A. Früngel, Vol. I, pp. 126–127. Triggering circuits for such systems are fairly complex, even if the cathode is grounded. In some cases, circuit requirements call for the cathode to be at high potential. This can present difficult isolation problems for a manually operated trigger circuit.

It is the object of the present invention to provide a spark gap switch, suitable for switching high voltage, high current electrical power, which provides safe isolation for the operator of the high voltage equipment.

The spark gap switch, in accordance with the present invention, comprises an anode and a cathode having facing surfaces separated by a predetermined gap, a trigger electrode located in the vicinity of such gap, and a piezoelectric generator connected between the trigger electrode and the cathode for triggering the spark gap switch.

In a preferred embodiment of the invention, an opening is provided in the center of the cathode and the trigger electrode is mounted in such opening and insulated from the cathode.

The piezoelectric generator is a conventional device of the type comprising a hammer which strikes a ceramic rod and is manually activated by a plunger connected to the hammer. In a preferred embodiment of the invention, the plunger is operated by a small pneumatic cylinder having its piston connected to the plunger. Air pressure is applied to the cylinder through a long plastic tube or hose thereby providing safe isolation for the operator of the high voltage equipment.

The invention will now be disclosed, by way of example, with reference to the accompanying drawing which illustrates a preferred embodiment of an electromechanically triggered spark gap switch.

The spark gap switch comprises an anode 10 and a cathode 12 of a size sufficient to handle the current requirement (possibly in the order of 100 kiloamps or higher) of a capacitor discharge circuit without significant power loss. These electrodes are held together along a common axis with a predetermined gap therebetween by a suitable insulating housing 14 equipped with conventional gas intake 16 and outlet 18 for maintaining a suitable gas pressure within the housing. The cathode has an opening in the surface thereof facing the anode and a trigger electrode 22 is supported in such opening by an insulating sleeve 24. However, other means of mounting the trigger electrode in the vicinity of the gap between the anode and cathode are also envisaged. A piezoelectric generator 26 is connected to the trigger electrode with one terminal and to the cathode with its other terminal. The piezoelectric generator is provided with a conventional plunger 28 which is operated by the piston 30 of a small pneumatic cylinder 32 when air pressure is applied to the intake nozzle 34 of the cylinder.

Inside the piezoelectric generator, a small hammer strikes a ceramic rod in a known manner. The piezoelectricity generated is substantial, and usually exceeds 10 kV. This voltage causes a sparkover between the trigger electrode and the cathode first, and subsequently between the cathode and anode by local ionization.

The piezoelectric generator is a common, mass produced device used in cigarette lighters and gas stove or gas barbeque lighters. Air pressure can be applied to the intake nozzle of the pneumatic cylinder through a long plastic tube or hose providing safe isolation for the operator of the high voltage equipment. Alternatively, the piezoelectric generator can be operated through an insulated push bar manually or by a solenoid or other type of actuator.

Another advantage of the piezoelectric triggering is that it converts readily available mechanical energy to electrical energy. Conventional electronic trigger circuits operate from isolated power supplies run off line voltage. In case of power failure, these trigger circuits become inoperative, but the high voltage storage capacitors could remain charged. The electromechanically triggered spark gap switch operates readily during power failure, making it ideal for crowbar service.

Although the invention has been disclosed with reference to a preferred embodiment, it is to be understood that it is not limited to such embodiment and that other alternatives are also envisaged within the scope of the following claims.

I claim:

1. A spark gap switch comprising (a) an anode and a cathode having facing surfaces separated by a predetermined gap;

(b) a trigger electrode located in the vicinity of said gap, and (c) a piezoelectric generator connected between said trigger electrode and the cathode for triggering said spark gap switch.

2. A spark gap switch as defined in claim 1 wherein an opening is provided in the center of the cathode and wherein said trigger electrode is mounted in said opening and insulated from the cathode.

3. A spark gap switch as defined in claim 1, wherein said piezoelectric generator comprises a hammer which strikes a ceramic rod for producing a spark exceeding 10 kV and further comprising a plunger for actuating said hammer.

4. A spark gap switch as defined in claim 3 wherein said plunger is operated by a pneumatic cylinder having a piston connected to said hammer and further comprising means for remotely applying air pressure to said cylinder.

5. A spark gap switch as defined in claim 3 wherein said plunger is operated by an insulated push bar.

* * * * *